US006028568A

United States Patent [19]

Asakura et al.

[11] Patent Number: 6,028,568

[45] Date of Patent: Feb. 22, 2000

[54] CHIP-ANTENNA

[75] Inventors: Kenji Asakura, Moriyama; Toshifumi Oida, Omihachiman; Harufumi Mandai, Takatsuki, all of Japan

[73] Assignee: Murata Manufacturing Co., Ltd., Japan

[21] Appl. No.: 09/208,223

[22] Filed: Dec. 9, 1998

[30] Foreign Application Priority Data

Dec. 11, 1997 [JP] Japan ..... 9-341493

[51] Int. Cl.[7] ..... H01Q 1/24

[52] U.S. Cl. ..... 343/895; 343/700 MS; 343/702; 343/873

[58] Field of Search ..... 343/700 MS, 702, 343/787, 788, 872, 873, 895; H01Q 1/24, 1/36

[56] References Cited

U.S. PATENT DOCUMENTS

| | | | |
|---|---|---|---|
| 3,417,403 | 12/1968 | Fenwick | 343/877 |
| 4,860,020 | 8/1989 | Wong et al. | 343/828 |
| 5,764,197 | 6/1998 | Tsuru et al. | 343/895 |
| 5,892,489 | 4/1999 | Kanba et al. | 343/895 |
| 5,900,845 | 5/1999 | Mandai et al. | 343/895 |

FOREIGN PATENT DOCUMENTS

| | | |
|---|---|---|
| 0650214 | 4/1995 | European Pat. Off. . |
| 0762538 | 3/1997 | European Pat. Off. . |
| 0777293 | 6/1997 | European Pat. Off. . |

*Primary Examiner*—Don Wong
*Assistant Examiner*—Tho Phan
*Attorney, Agent, or Firm*—Ostrolenk, Faber, Gerb & Soffen, LLP

[57] ABSTRACT

The invention provides a chip-antenna, comprising: a base member including a mounting surface and made of at least one of dielectric ceramic and magnetic ceramic; at least two conductors disposed within said base member or on a surface of said base member, at least a portion of said conductors being substantially perpendicular to the mounting surface of said base member; a feeding electrode for applying a voltage to said conductors and disposed on the surface of said base member; a ground electrode disposed at least one on the surface of and within said base member; one of said conductors being served as a first conductor, one end of which is connected to said feeding electrode; the rest of said conductor being served as a second conductor, one end of which are connected to said ground electrode; and the other end of said first conductor and the other end of said second conductor being connected.

12 Claims, 7 Drawing Sheets

CHIP-ANTENNA

BACKGROUND OF THE INVENTION

1. Field of the Invention

The present invention relates to a chip-antenna. More particularly, the present invention relates to a chip-antenna for use in a low-frequency band radio equipment such as a television, a radio, a pager, for example.

2. Description of the Related Art

In FIG. 12, a monopole antenna 100 as a representative wire antenna is shown. This monopole antenna 100 has a radiating element 102 set up substantially perpendicular to the grounding surface 101 in air (dielectric constant $\epsilon=1$, relative magnetic permeability $\mu=1$). And, a feeding power supply V is connected to one end 103 of this radiating element 102, and the other end 104 is kept open.

However, in the case of the above-mentioned conventional monopole antenna, as the radiating element of the antenna is placed in the air, the dimensions of the radiating element of the antenna become large. For example, assuming that the wavelength in the air is $\lambda$, a radiating element having a length of $\lambda/4$ is required and then the length of the radiating element of a monopole antenna becomes as long as about 40 mm for a 1.9 GHz band. Further, the bandwidth of a monopole antenna having a reflection loss of less than −6 (dBd) is as narrow as about 30 MHz. Accordingly, there has been a problem that it is difficult to use the monopole antenna in the cases where a small-sized and wide-band antenna is needed.

SUMMARY OF THE INVENTION

Preferred embodiments of the present invention are provided to overcome the above described problems, and provide a small-sized chip-antenna to be able to be used for a wide-band radio equipment.

A preferred embodiment of the present invention provides a chip-antenna, comprising: a base member including a mounting surface and made of at least one of dielectric ceramic and magnetic ceramic; at least two conductors disposed within said base member or on a surface of said base member, at least a portion of said conductors being substantially perpendicular to the mounting surface of said base member; a feeding electrode for applying a voltage to said conductors and disposed on the surface of said base member; a ground electrode disposed at least one on the surface of and within said base member; one of said conductors being served as a first conductor, one end of which is connected to said feeding electrode; the rest of said conductor being served as a second conductor, one end of which are connected to said ground electrode; and the other end of said first conductor and the other end of said second conductor being connected.

According to the above described chip-antenna, because the first conductor and the second conductor are connected in series between the feeding electrode and the ground electrode respectively disposed on the surface of the base member, a capacitance is able to be given between the ground on the mounting substrate where the chip-antenna is mounted and the vicinity of the connecting portion of the other end of the first conductor and the other end of the second conductor. As a result, only the capacitance component C is able to be increased without changing the inductance component L and the resistance component R of the first conductor and the second conductor.

Therefore, because the value of Q $(=(L/C)^{1/2}/R)$ of the chip-antenna is able to be decreased, the bandwidth of the chip-antenna becomes widened, and accordingly it becomes possible to widen the bandwidth of a small-sized chip-antenna even if its height is less than one tenth of a conventional monopole antenna. As the result, a radio equipment mounted with such a chip-antenna and requiring frequencies of a wide band is able to be small-sized.

In the above described chip-antenna, a capacitance loading conductor may be disposed at least one on the surface of or within said base member, and the other end of said first conductor and the other end of said second conductor are connected via said capacitance loading conductor.

According to the above structure, because the first conductor and the second conductor are connected in series via the capacitance loading conductor between the feeding electrode and the ground electrode respectively disposed on the surface of the base member, a capacitance given between the capacitance loading conductor and the ground on the mounting substrate where the chip-antenna is mounted is able to be controlled by choosing the area of the capacitance loading conductor. As the result, the input impedance of the chip-antenna can be controlled.

Accordingly, by optimizing the area of the capacitance loading conductor the input impedance of the chip-antenna is able to be made in agreement with the characteristic impedance of the high-frequency portion of a radio equipment with the chip-antenna mounted, and any matching circuits become unnecessary. As the result, a radio equipment with the chip-antenna mounted is realized to be of small size.

In the above described chip-antenna, a gap portion may be provided in said base member between said first conductor and second conductor.

According to the above structure, the relative dielectric constant of the base member is able to be adjusted by adjusting the size of the gap portion, and thereby the value of a capacitance given between the ground on the mounting substrate where the chip-antenna is mounted and the vicinity of the connecting portion of the other end of the first conductor and the other end of the second conductor can be adjusted. Therefore, the input impedance of a chip-antenna can be more precisely matched to the characteristic impedance of a radio equipment with a chip-antenna to be mounted. Further, by forming a gap portion in a base member, the base member becomes light-weighted and accordingly the weight of a chip-antenna is made light.

In the above described chip-antenna, said first and second conductors may be wound in substantially spiral shape.

According to the above structure, the line length of the first and second conductors is able to be lengthened, and the current distribution can be increased. Accordingly, the gain of the chip-antenna can be improved.

In the above described chip-antenna, said first and second conductors may be wound in substantially helical shape.

According to the above structure, the line length of the first and second conductors is also able to be lengthened, and the current distribution can be increased. Accordingly, the gain of the chip-antenna can be improved.

Other features and advantages of the present invention will become apparent from the following description of the invention which refers to the accompanying drawings.

DESCRIPTION OF THE PREFERRED EMBODIMENTS

Figure 1:
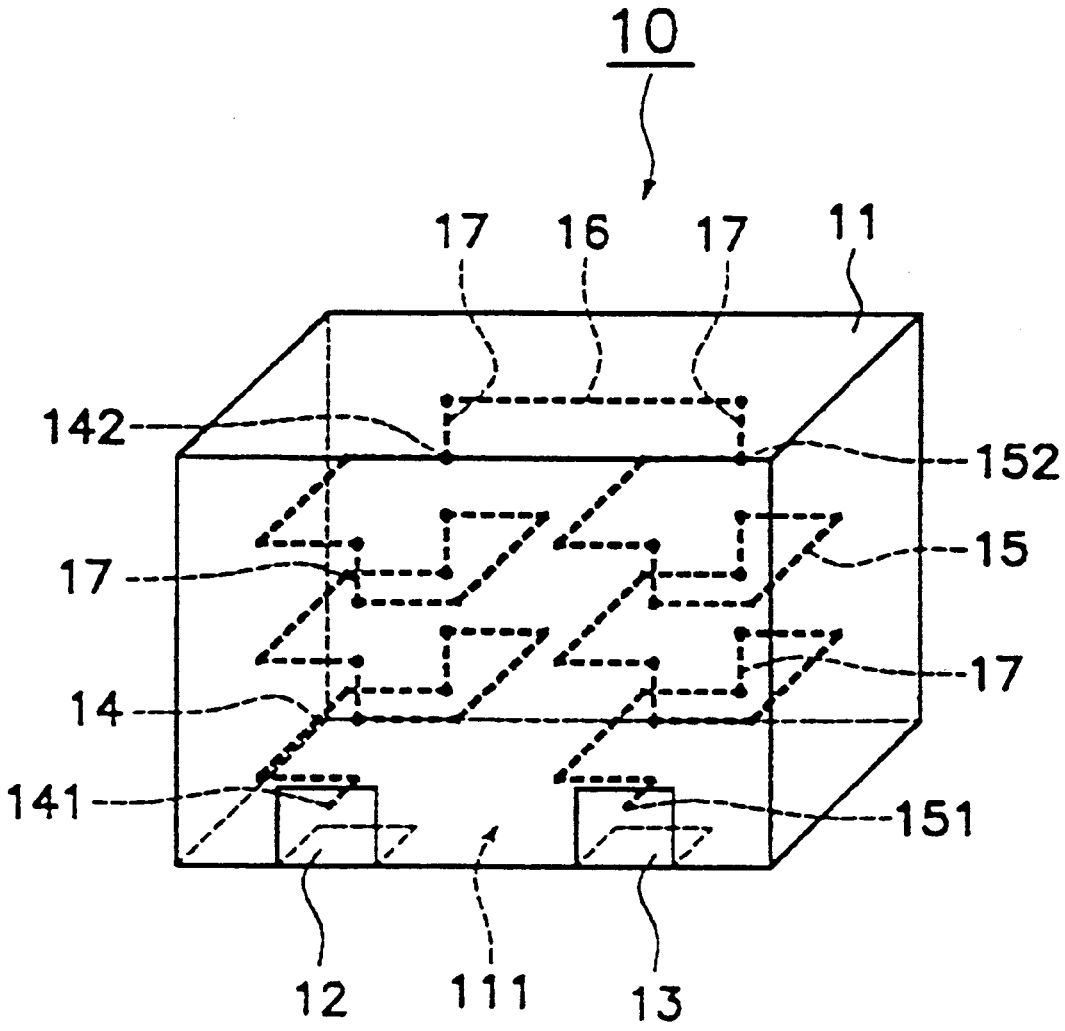
FIG. 1 is a perspective view of a chip-antenna according to a first preferred embodiment of the present invention.
Figure 2:
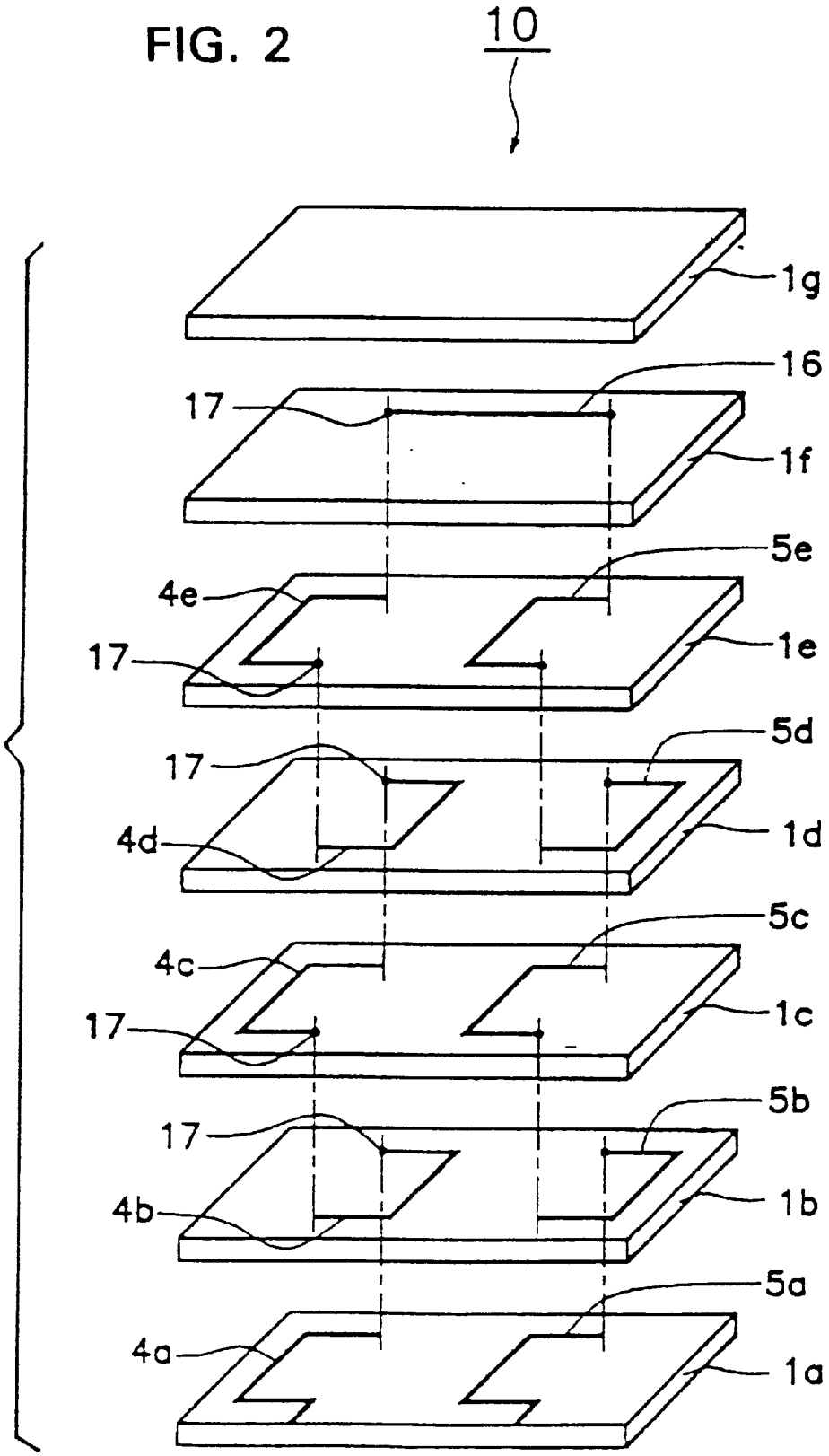
FIG. 2 is an exploded perspective view of the chip-antenna in FIG. 1.

In FIGS. 1 and 2, a perspective view and an exploded perspective view of a first preferred embodiment of a chip-antenna according to the present invention are shown. The chip-antenna 10 comprises a base member 11 of a rectangular solid having a mounting surface 111 and a feeding electrode 12 and a ground electrode 13 are disposed on the surface of the base member 11.

Further, a first conductor 14 with one end 141 connected to the feeding electrode 12 and a second conductor 15 with one end 151 connected to the ground electrode 13, both of which are spirally wound and the spiral axis thereof are perpendicular to the mounting surface 111 of the base member 11 i.e., in the direction of height of the base member 11 are disposed within the base member 11. In this case, the other end 142 of the first conductor 14 and the other end 152 of the second conductor 15 are connected via a connecting line 16. Accordingly, the first conductor 14 and the second conductor 15 come to have been connected in series between the feeding electrode 12 and the ground electrode 13 disposed on the surface of the base member 11. In this embodiment, the external dimensions of the chip-antenna are, for example, of a measure of 10.0 mm (L)×6.3 mm (W)×5.0 mm (H). And, the base member 11 is formed by laminating rectangular thin layers 1*a* through 1*g* made of dielectric ceramics, the main components of which are barium oxide, aluminum oxide, and silica.

On the surface of thin layers 1*a* through 1*f* out of these, conductor patterns 4*a* through 4*e*, 5*a* through 5*e* having substantially an U-shaped form and a connecting line 16 having substantially a linear shape of copper or copper alloy are provided by printing, evaporation, pasting, or plating. Further, via holes 17 are provided at a predetermined position of thin layers 1*b* through 1*f* (one end of conductor patterns 4*b* through 4*e*, 5*b* through 5*e* and both ends of a connecting line 16) in the thickness direction.

And by the processes of laminating and sintering thin layers 1*a* through 1*g*, connecting conductor patterns 4*a* through 4*e*, 5*a* through 5*e* through via holes 17, and connecting the conductor pattern 4*e* and conductor pattern 5*e* by way of a connecting line 16 and via holes 17, the first conductor 14 and second conductor 15 which are spirally wound in the direction of height of the base member 11 and the other ends of which are connected together, are formed within the base member 11.

In this case, one end of the first conductor 14 (one end of the conductor pattern 4*a*) is led out to one surface of the base member 11 and connected the feeding electrode 17 disposed on the surface of the base member 11 in order to apply a voltage to the first and second conductors 14, 15. Also, one end of the second conductor 15 (one end of the conductor pattern 5*a*) is led out on the surface of the base member 11 and connected to the ground electrode 13 disposed on the surface of the base member 11 in order to be connected to the ground (not illustrated) on a mounting substrate for the chip-antenna 10 to be mounted.

In the chip-antenna 10 constructed this way, as the first and second conductors 14, 15 are spirally wound inside the base member 11, the line length of the first and second conductors 14, 15 is able to be lengthened and accordingly the distribution of current is able to be increased. Therefore, the gain of the chip-antenna 10 can be improved.

Figure 3:
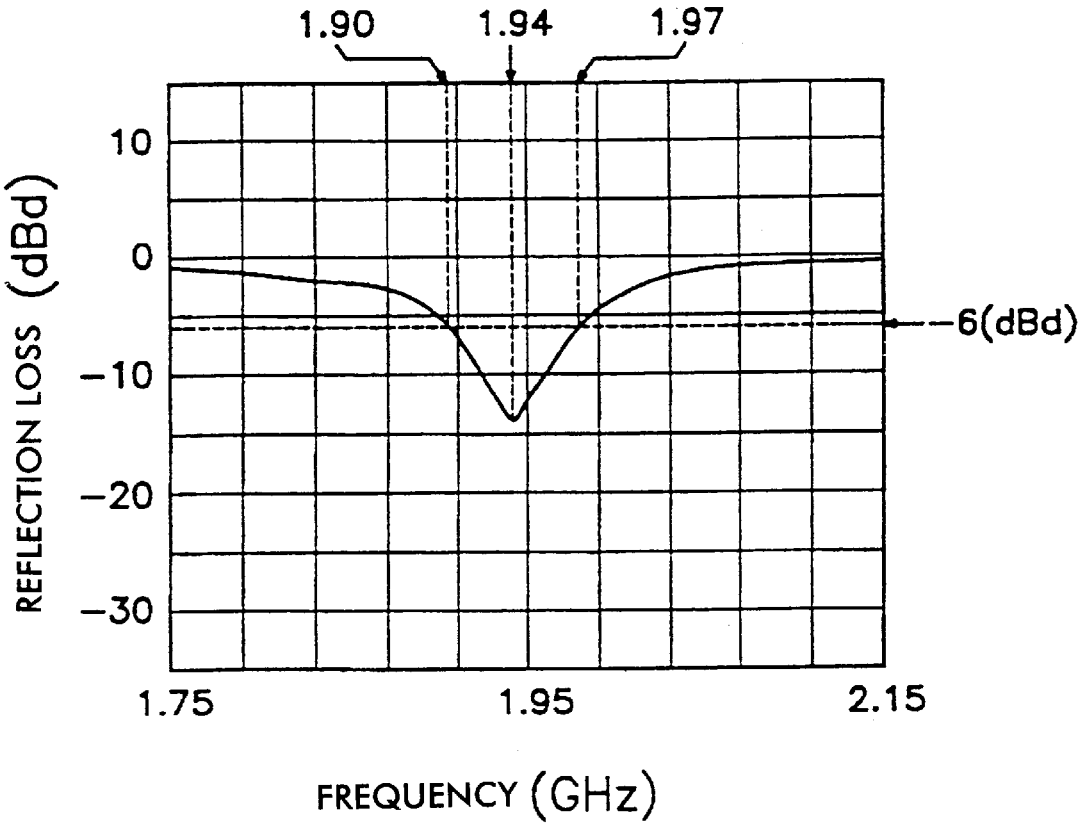
FIG. 3 shows the frequency characteristic of insertion loss of the chip-antenna in FIG. 1.

In FIG. 3, the frequency characteristic of the reflection loss of the chip-antenna (FIG. 1) is shown. From this drawing, it is understood that the bandwidth in which a reflection loss is of less than −6 (dBd) in reference to the central frequency of 1.94 GHz is about 70 MHz, that is, a wider bandwidth has been attained.

Figure 4:
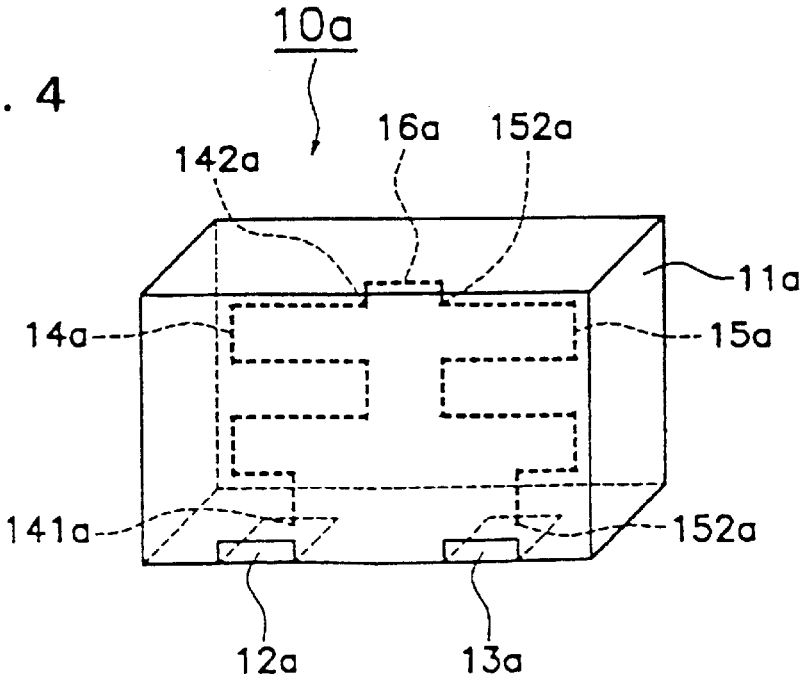
FIG. 4 is a perspective view of a modification of the chip-antenna in FIG. 1.

In FIG. 4, a perspective view of a modification of the chip-antenna in FIG. 1 is shown. In the chip-antenna 10*a*, a base member 11*a* of a rectangular solid, a feeding electrode 12*a* and a ground electrode 13*a* disposed on the surface of the base member 11*a*, and first and second conductors 14*a*, 15*a* meanderingly formed within the base member 11*a* are given. At this time, on the surface of the base member 11*a*, one end 141*a* of the first conductor 14*a* is connected to a feeding electrode 12*a* and one end 151*a* of the second conductor 15*a* is connected to a ground electrode 13*a* respectively. Further, within the base member 11*a*, the other end 142*a* of the first conductor 14*a* and the other end 152*a* of the second conductor 15*a* are connected. In the chip-antenna 10*a* constructed this way, as the first and second conductors 14*a*, 15*a* are meanderingly formed within the base member 11*a*, the line length of the first and second conductors 14*a*, 15*a* is able to be lengthened and accordingly the distribution of current is able to be increased. Therefore, the gain of the chip-antenna 1O*a* can be improved. Further, the first and second conductors 14*a*, 15*a* of a meandering form may be formed on the surface (one main surface) of the base member 11*a*.

As described above, according to a chip-antenna of the first preferred embodiment, because the first conductor and the second conductor are connected in series between a feeding electrode and a ground electrode disposed on the surface of a base member, between the vicinity of a connection of the other end of the first conductor and the other end of the second conductor, that is, the connecting line and the ground on the mounting substrate on which a chip-antenna is mounted a capacitance is able to be given, and without changing the inductance components and resistance components of the first conductor and second conductor it is possible to increase only the capacitance component. Accordingly, because the value of Q ($=(L/C)^{1/2}/R$) of the chip-antenna is able to be decreased, the bandwidth of the chip-antenna is widened and then it becomes possible to widen the bandwidth of a small-sized chip-antenna even if its height is less than one tenth of a conventional monopole antenna. As the result, a radio equipment mounted with such a chip-antenna and requiring frequencies of a wide band is able to be made of small size.

Figure 5:
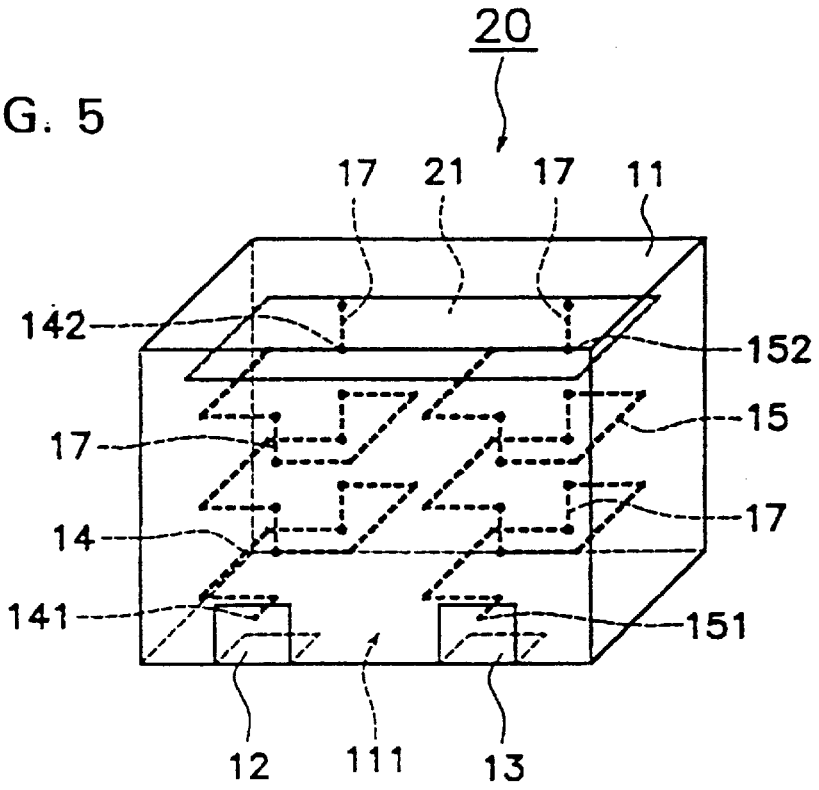
FIG. 5 is a perspective view of a chip-antenna according to a second preferred embodiment of the present invention.

In FIG. 5, an exploded perspective view of a second embodiment of a chip-antenna according to the present invention is shown. The chip-antenna 20 is different from the chip-antenna 10 of the first preferred embodiment in that the other end 142 of a first conductor 14 and the other end 152 of a second conductor 15 are connected to a capacitance loading conductor 21 disposed within the base member 11 through via holes 17.

Accordingly, the first conductor 14 and second conductor 15 come to have been connected in series between a feeding electrode 12 and a ground electrode 13 disposed on the surface of the base member 11 through the capacitance loading conductor 21.

As described above, according to the chip-antenna of the second preferred embodiment, because between the feeding electrode and the ground electrode disposed on the surface of the base member the first conductor and second conductor are connected in series through the capacitance loading conductor, by choosing the area of the capacitance loading conductor a capacitance given between the capacitance loading conductor and the ground on the mounting substrate for the chip-antenna to be mounted is able to be controlled. As the result, the input impedance to the chip-antenna can be controlled.

Therefore, by optimizing the area of a capacitance feeding conductor the input impedance of a chip-antenna is able to be made in agreement with the characteristic impedance of the high-frequency portion of a radio equipment with a chip-antenna mounted, and any matching circuit becomes unnecessary. As the result, a radio equipment of small size is realized.

More, between a capacitance loading conductor and a ground on the mounting substrate for a chip-antenna to be mounted on, a larger capacitance is able to be given. Accordingly, because the value of Q ($=(L/C)^{1/2}/R$) of the chip-antenna is able to be decreased, the bandwidth of the chip-antenna can be made wider.

More, even if a capacitance loading conductor 21 is disposed on the surface of the base member 11, the same effect can be obtained.

Figure 6:
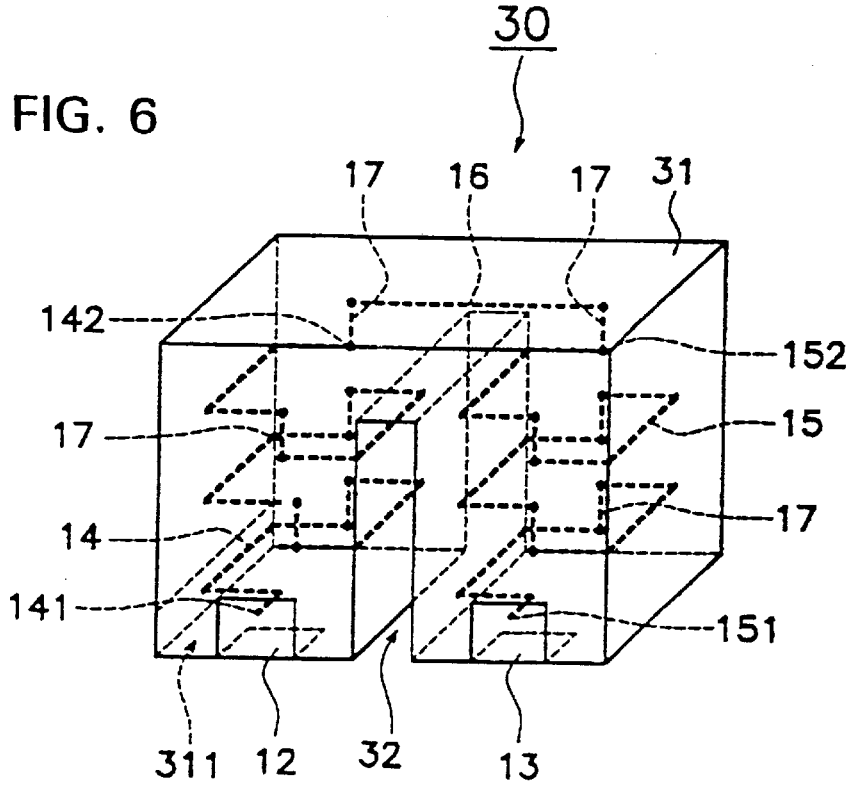
FIG. 6 is a perspective view of a chip-antenna according to a third embodiment of the present invention.

FIG. 6 shows a perspective view of a third preferred embodiment of a chip-antenna according to the present invention. The chip-antenna 30 is different from the chip-antenna 10 of the first preferred embodiment in that a base member 31 has a gap portion between a first conductor 14 and a second conductor 15.

Figure 7:
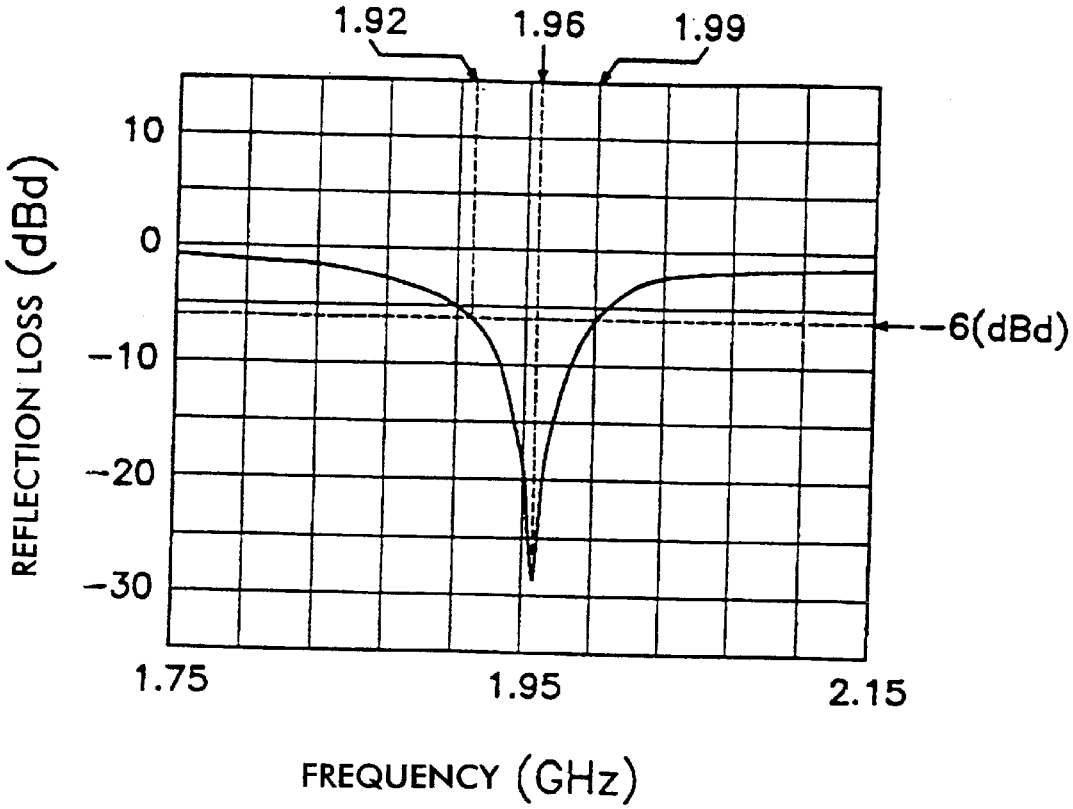
FIG. 7 shows the frequency characteristic of insertion loss of the chip-antenna in FIG. 6.

FIG. 7 shows the frequency characteristic of reflection loss of the chip-antenna 30 shown in FIG. 6. From this drawing, it is understood that the bandwidth in which a reflection loss is of less than −6 (dBd) in reference to the frequency of 1.96 GHz is about 70 MHz, that is, a wider bandwidth has been attained.

Figure 8:
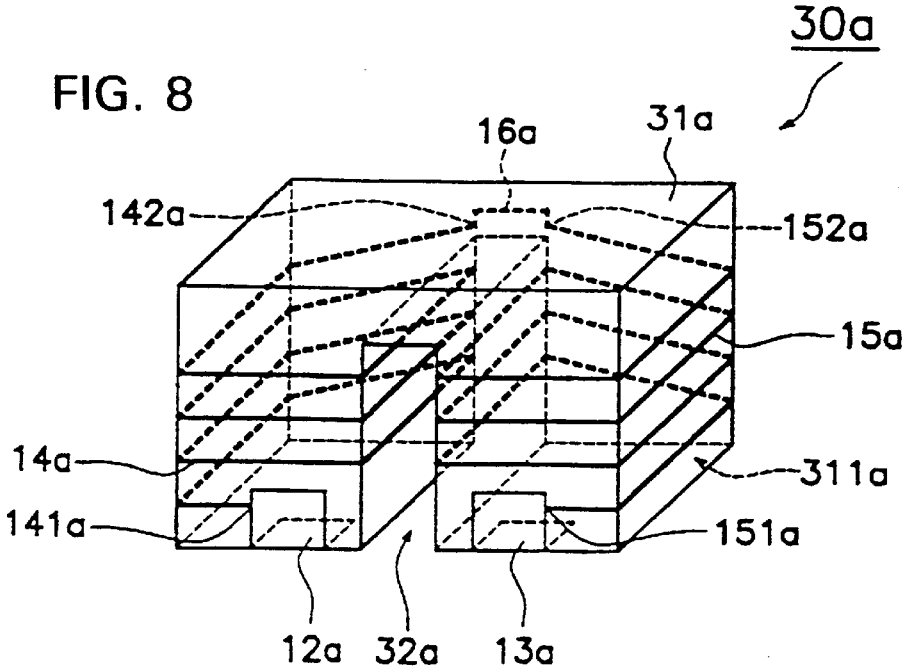
FIG. 8 is a perspective view of a modification of the chip-antenna in FIG. 6.

FIG. 8 shows a perspective view of a modification of the chip-antenna 30 in FIG. 6. In the chip-antenna 30*a* shown in FIG. 8, a base member 31*a* having a rectangular shape, a feeding electrode 12*a* and a ground electrode 13*a* disposed on the surface of the base member 31*a*, and first and second conductors 14*a*, 15*a* spirally wound in the direction of height of the base member 31*a* along the surface of the base member 11*a* are given. At this time, on the surface of the base member 31*a*, one end 141*a* of the first conductor 14*a* is connected to a feeding electrode 12*a* and one end 151*a* of the second conductor 15*a* is connected to a ground electrode 13*a* respectively. Further, on the surface of the base member 31*a*, the other end 142*a* of the first conductor 14*a* and the other end 152*a* of the second conductor 15*a* are connected through a connecting line 16*a*. In the chip-antenna 10*a* constructed this way, as the first and second conductors 14*a*, 15*a* are easily spirally formed on the surface of the base member 31*a* by screen printing, etc., the manufacturing processes of the chip-antenna 10*a* can be made simple.

As described above, according to the chip-antenna of the third preferred embodiment, because the gap portion is given to the base member and accordingly by adjusting the size of the gap portion the relative dielectric constant of the base member is able to be adjusted, the value of a capacitance given between the vicinity of the connecting portion of the other end of the first conductor and the other end of the second conductor and the ground on the mounting substrate where the chip-antenna is mounted can be adjusted. Therefore, the input impedance of the chip-antenna can be more precisely to the characteristic impedance of the radio equipment with a chip-antenna to be mounted.

Further, by providing a gap portion in the base member, the base member becomes light-weighted and accordingly the weight of the chip-antenna is made light.

Figure 9:
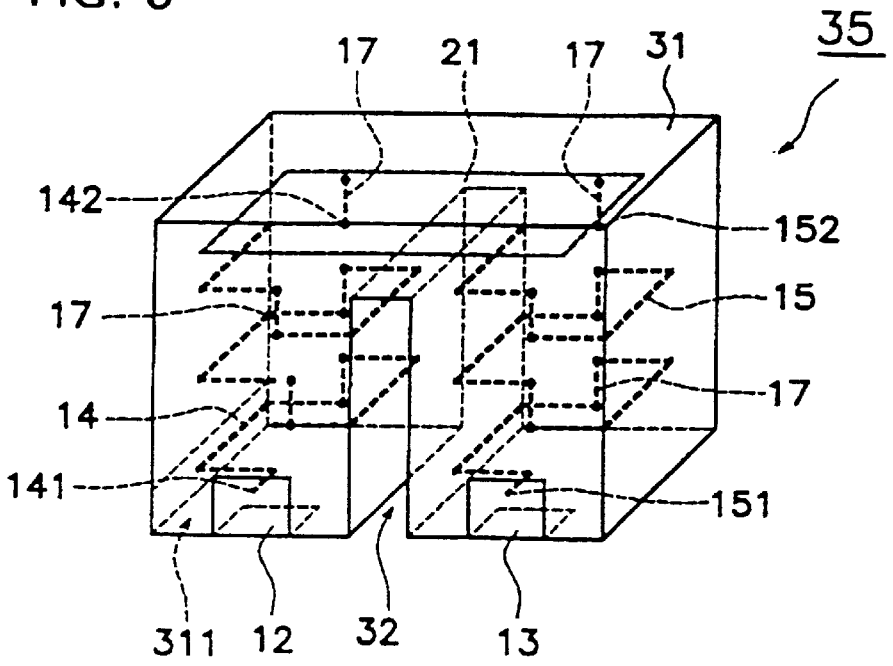
FIG. 9 is a perspective view of a chip-antenna according to a fourth embodiment of the present invention.

FIG. 9 shows an exploded perspective view of a fourth preferred embodiment of a chip-antenna according to the present invention. The chip-antenna 40 is different from the chip-antenna of the third preferred embodiment in that the other end 142 of a first conductor 14 and the other end 152 of a second conductor 15 are connected to a capacitance loading conductor 21 provided within the base member 11 through via holes 17.

Therefore, in the same way as the chip-antenna 20 of the second preferred embodiment the first conductor 14 and the second conductor 15 come to have been connected in series between a feeding electrode 12 and a ground 13 disposed on the surface of the base member 11 via the capacitance loading conductor 21.

Figure 10:
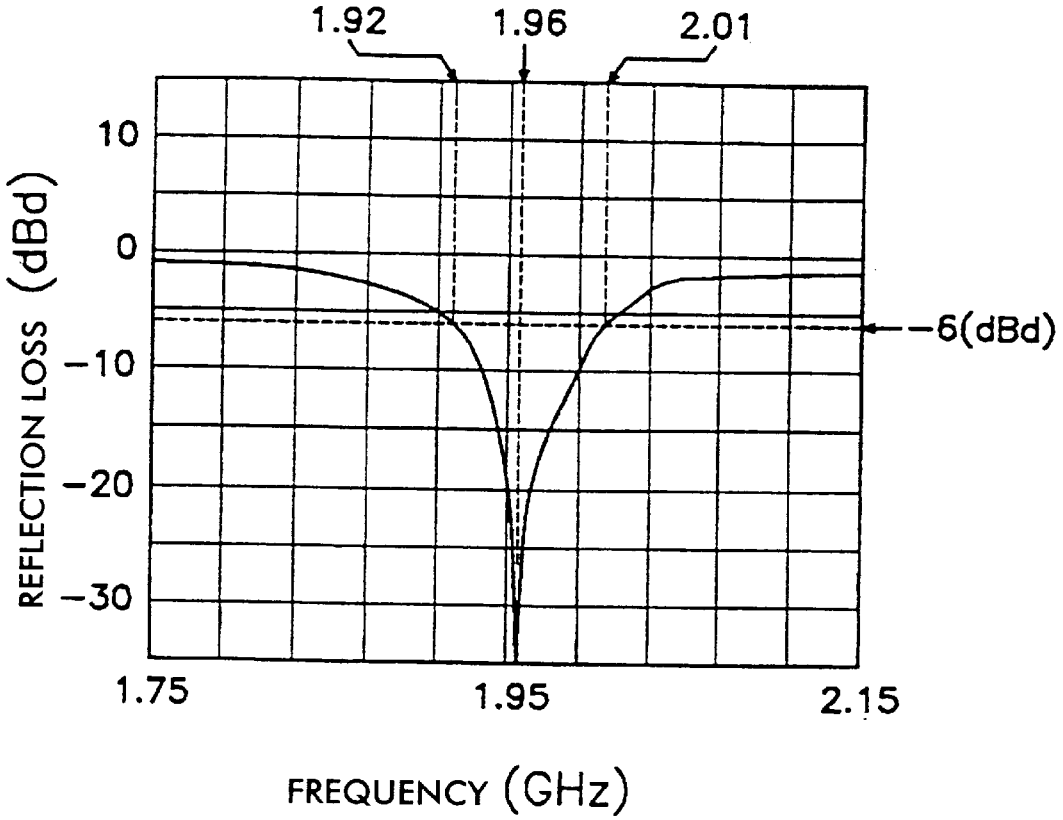
FIG. 10 shows the frequency characteristic of insertion loss of the chip-antenna in FIG. 9.

FIG. 10 shows the frequency characteristic of reflection loss of the chip-antenna 40 (FIG. 9). From this drawing, it is understood-that the bandwidth in which a reflection loss of less than −6 (dBd) in reference to the central frequency of 1.96 GHz is about 90 MHz and when compared with the chip-antenna 30 of the third embodiment a wider bandwidth has been attained.

As described above, according to the chip-antenna of the fourth preferred embodiment, between the capacitance loading conductor and the ground on the mounting substrate where the chip-antenna is to be mounted a larger capacitance is given. Accordingly, because the value of Q ($=(L/C)^{1/2}/R$) of the chip-antenna is able to be decreased, the bandwidth of the chip-antenna can be made wider.

Figure 11:
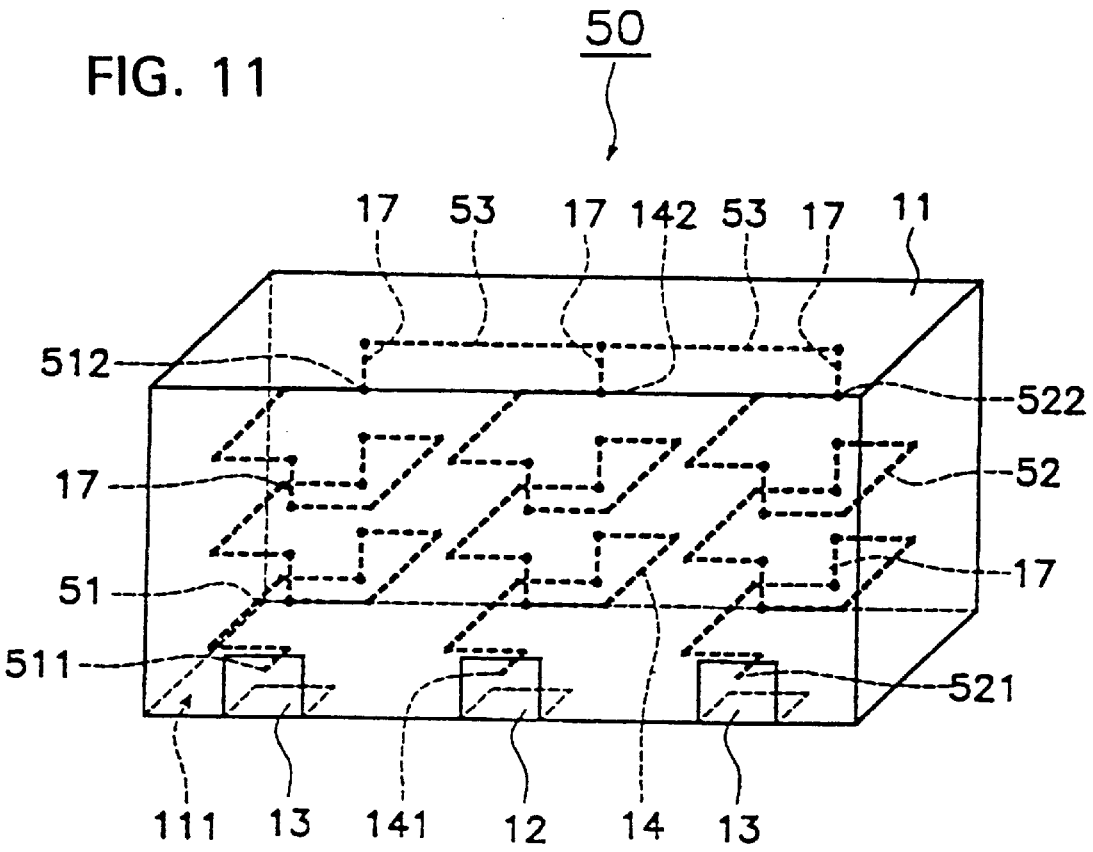
FIG. 11 is a perspective view of a chip-antenna according to a fifth preferred embodiment of the present invention.
Figure 12:
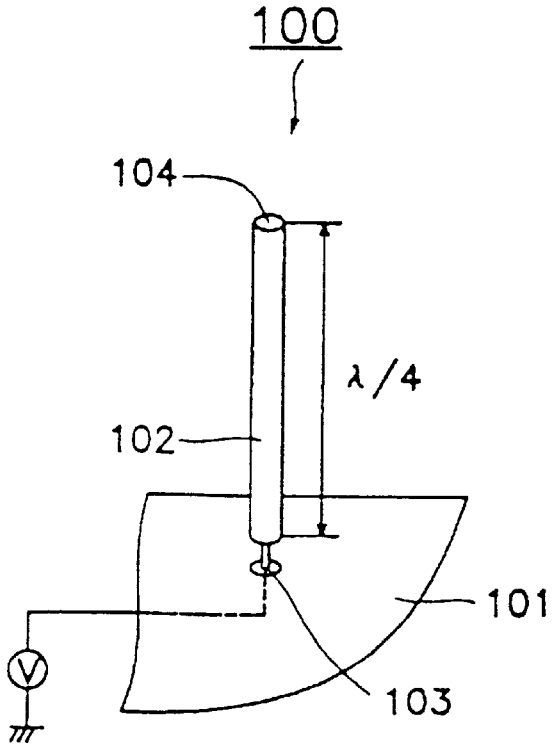
FIG. 12 PRIOR ART
FIG. 12 shows a conventional monopole antenna.

FIG. 11 shows a perspective view of a fifth preferred embodiment of a chip-antenna according to the present invention. The chip-antenna 50 is different from the chip-antenna of the first preferred embodiment in that a first conductor 14 with one end 141 connected to a feeding electrode 12 and two second electrodes 51, 52 with one ends 511, 512 connected to a ground electrode 13 are given and the other end 142 of the first conductor 14 and the other ends 512, 522 of the second conductors 51, 52 are connected via a connecting line 53.

Therefore, the first conductor 14 and one second conductor 51, and the first conductor 14 and the other second conductor 52 come to have been connected in series between the feeding electrode 12 and the ground electrode 13 disposed on the surface of the base member 11 via the connecting line 53 disposed within the base member 11.

As described above, according to the chip-antenna of the fifth preferred embodiment, because between the feeding electrode and the ground electrode the first conductor and one of the second conductors and the first conductor and the other of the second conductors are connected in series respectively, by adjusting the ratio of the number of turns of the first conductor to that of the second conductors and the ratio of the number of turns of the first conductor to that of the other of the second conductors, the input impedance of the chip-antenna is able to be fine-adjusted. Accordingly, it becomes possible to adjust the input impedance of the chip-antenna to the characteristic impedance of a radio equipment which is mounted with the chip-antenna.

Further, because two second conductors are used, the chip-antenna is able to have two resonance frequencies. As the result, a wider bandwidth can be realized.

Furthermore, in the above-mentioned second and third preferred embodiments, the cases in which the gap portion is given from substantially the central portion to the mounting surface of the base member are explained, but even if the gap portion is given from substantially the central portion to the surface opposite to the mounting surface of the base member or even if the gap portion is given like a cavity substantially at the central portion of the base member, the same effect can be obtained.

More, in the above-mentioned fourth preferred embodiment, the cases in which the other end of the first conductor and the other ends of a plurality of second conductors are connected via the connecting line were explained, but like the third preferred embodiment the same effect can be obtained even if the other end of the first conductor and the other ends of a plurality of second conductors are connected via the capacitance loading conductor.

More, three or more second conductors may be given. In this case, when the number of second conductors is increased, the input impedance of the chip-antenna can be more accurately fine-adjusted. Therefore, it becomes possible to adjust the chip-antenna more precisely to the characteristic impedance of the high-frequency portion of a radio equipment mounted with the chip-antenna.

While the invention has been particularly shown and described with reference to preferred embodiments thereof, it will be understood by those skilled in the art that the forgoing and other changes in form and details may be made therein without departing from the spirit of the invention.

What is claimed is:

1. A chip-antenna, comprising:

a base member including a mounting surface and made of at least one of dielectric ceramic and magnetic ceramic;

at least two conductors disposed within said base member or on a surface of said base member, at least a portion of said conductors being substantially perpendicular to the mounting surface of said base member;

a feeding electrode for applying a voltage to said conductors and disposed on the surface of said base member;

a ground electrode disposed at least one on the surface of and within said base member;

one of said conductors being served as a first conductor, one end of which is connected to said feeding electrode;

the rest of said conductor being served as a second conductor, one end of which are connected to said ground electrode; and the other end of said first conductor and the other end of said second conductor being connected.

2. The chip-antenna according to claim 1, wherein a capacitance loading conductor is disposed at least one on the surface of or within said base member, and the other end of said first conductor and the other end of said second conductor are connected via said capacitance loading conductor.

3. The chip-antenna according to claim 2, wherein a gap portion is provided in said base member between said first conductor and second conductor.

4. The chip-antenna according to claim 3, wherein said first and second conductors are wound in substantially spiral shape.

5. The chip-antenna according to claim 3, wherein said first and second conductors are wound in substantially helical shape.

6. The chip-antenna according to claim 2, wherein said first and second conductors are wound in substantially spiral shape.

7. The chip-antenna according to claim 2, wherein said first and second conductors are wound in substantially helical shape.

8. The chip-antenna according to claim 1, wherein a gap portion is provided in said bass member between said first conductor and second conductor.

9. The chip-antenna according to claim 8, wherein said first and second conductors are wound in substantially spiral shape.

10. The chip-antenna according to claim 8, wherein said first and second conductors are wound in substantially helical shape.

11. The chip-antenna according to claim 1, wherein said first and second conductors are wound in substantially spiral shape.

12. The chip-antenna according to claim 1, wherein said first and second conductors are wound in substantially helical shape.

* * * * *